United States Patent [19]

Hillier et al.

[11] Patent Number: 4,729,232

[45] Date of Patent: Mar. 8, 1988

[54] MACHINES FOR PRESSURE FORMING SURFACE CONFIGURATIONS ON A ROTARY WORKPIECE

[75] Inventors: Malcolm E. Hillier, Basingstoke; John Maddaford, Belton-in-Rutland, both of England

[73] Assignee: Anderson-Cook, Inc., Fraser, Mich.

[21] Appl. No.: 9,637

[22] Filed: Jan. 27, 1987

Related U.S. Application Data

[63] Continuation of Ser. No. 796,466, Nov. 8, 1985, abandoned.

[30] Foreign Application Priority Data

Nov. 8, 1984 [GB] United Kingdom ..... 8428220

[51] Int. Cl.[4] ..... B21D 37/14

[52] U.S. Cl. ..... 72/88; 72/481

[58] Field of Search ..... 72/88, 90, 469, 481, 72/482

[56] References Cited

U.S. PATENT DOCUMENTS

| | | | |
|---|---|---|---|
| 1,741,405 | 12/1929 | Coe | 72/244 |
| 2,975,743 | 3/1961 | Hoffmann et al. | 72/102 |
| 3,096,686 | 7/1963 | Davenport et al. | 409/14 |
| 3,199,859 | 8/1965 | Heynen et al. | 269/25 |
| 3,318,130 | 5/1967 | Sendzimir | 72/244 |
| 3,687,016 | 8/1972 | Thomas et al. | 269/25 |
| 3,695,078 | 10/1972 | Bruinsma | 72/102 |
| 4,016,738 | 4/1977 | Puchko et al. | 72/469 |
| 4,258,620 | 3/1981 | Sallander | 100/918 |
| 4,519,231 | 5/1985 | Roth | 72/88 |

FOREIGN PATENT DOCUMENTS

| | | | |
|---|---|---|---|
| 2065506 | 12/1973 | Fed. Rep. of Germany | 269/25 |
| 45831 | 3/1983 | Japan | 269/25 |

*Primary Examiner*—Lowell A. Larson

*Attorney, Agent, or Firm*—Reising, Ethington, Barnard, Perry & Milton

[57] ABSTRACT

The invention relates to apparatus 1 for holding a tool of a machine 2 for pressure forming surface configurations on a rotary workpiece comprising an elongate support 3 (of L-shape) on which a tool 4 is mountable, first automatic 5 means for shifting the support 3 longitudinally for adjusting the position of the tool 4, and second automatic means 6 for securing the support 3 in a shifted position.

6 Claims, 9 Drawing Figures

MACHINES FOR PRESSURE FORMING SURFACE CONFIGURATIONS ON A ROTARY WORKPIECE

This application is a continuation of application Ser. No. 796,466, filed Nov. 8, 1985, now abandoned.

The invention relates to machines for pressure forming surface configurations on a rotary workpiece, and particularly relates to apparatus for holding a tool of such a machine.

In such machines metal workpieces are formed between a pair of opposed, substantially parallel reciprocating dies, tools or tool members. As the tools reciprocate (in opposite directions usually) they apply pressure to the workpiece and form or shape it. One disadvantage of these machines is that the tools (mounted on supports have to be mounted and dismounted from the machines using a time consuming manual operation, which is also the case when the tools are required to be adjusted in position relative to one another.

It is thus among the objects of the invention to seek to mitigate these disadvantages of the prior art.

According to a first aspect of the invention there is provided apparatus for holding a tool of a machine for pressure forming surface configurations on a rotary workpiece, comprising an elongate support on which a tool is mountable, first automatic means for shifting the support longitudinally for adjusting the position of the tool, and second automatic means for securing the support in a shifted position.

The first automatic means may comprise a bearing surface and the support may comprise a bearing surface whereby the two surfaces bear on one another when the support is shifted longitudinally.

Preferably the arrangement is such that the cooperation of the bearing surfaces provides both horizontal and vertical elements of force on the support to move same and retain it in the shifted position.

The respective bearing surfaces may be inclined.

The first automatic means may comprise a block one face of which comprises the bearing face, resilient means normally urging the block away from the support, and hydraulic means operative to urge the block against the bias of the resilient means to engage the support.

The resilient means may comprise a spring connected at one end to the block and at the other end to a stock in which the block slides.

The second automatic means may comprise complementary locking and engaging means of the support and of a clamp therefor, the clamp being operative to clamp the support in a direction transversely to the longitudinal axis thereof.

The direction of clamping may be substantially 90° to the longitudinal axis.

The complementary locking and engaging means may comprise a T-or key-hole configured slot of the support and a T-section clamp resiliently mounted normally to engage the support and clamp it and hydraulic means operative to overcome the resilient means for disengaging the support and clamp when the support moves longitudinally.

The hydraulic means of the first and second automatic means may be operated automatically in synchronism for shifting the support and for securing same in a shifted position.

According to a second aspect of the invention there is provided apparatus for holding a tool of a machine for pressure forming surface configuration on a rotary workpiece, comprising an elongate support on which a tool is mountable, a device for adjusting the vertical position of the support, and motor means for actuating the device whereby the vertical position of the support is adjusted.

The device may be a wedge on which the support bears and which is movable horizontally by the motor actuating means for adjusting the vertical position of the support.

The motor actuating means may comprise a nut retained in the wedge for vertically floating with respect thereto, threaded means engaged with the nut and with a drive connector, and a motor drivingly connected with the drive connector whereby rotation can be imparted to the threaded means for acting on the nut to transmit thrust to the wedge.

The threaded means may be a shaft and the drive connection may comprise a drive connector on the shaft, a spline shaft parallel to the shaft carrying a further drive connector, an endless member connecting the two connectors, the motor being operatively connected with the spline shaft for rotating same whereby drive is transmitted via the endless member to the shaft.

The spline shaft which may be a ball spline shaft, may be connected with a slave unit which can provide an indication of the position of the wedge.

According to a third aspect of the invention there is provided a machine for pressure forming surface configurations on a rotary workpiece, including apparatus as hereinabove defined.

Apparatus embodying the invention is hereinafter described, by way of example, with reference to the accompanying drawings, in which:

FIGS. 1 to 3;

Figure 1:
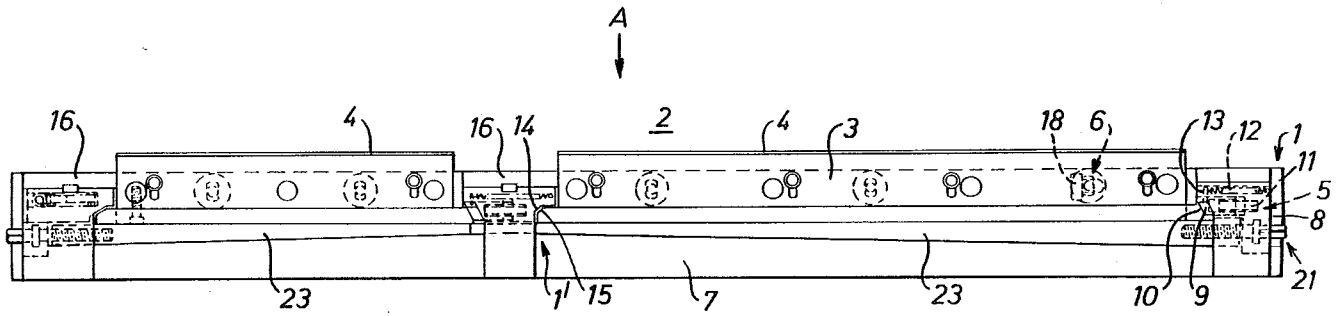
FIG. 1 is a front elevational view of apparatus for holding a tool of a machine for pressure forming surface configurations such as splines on a rotary workpiece, particularly first automatic means thereof.
Figure 2:
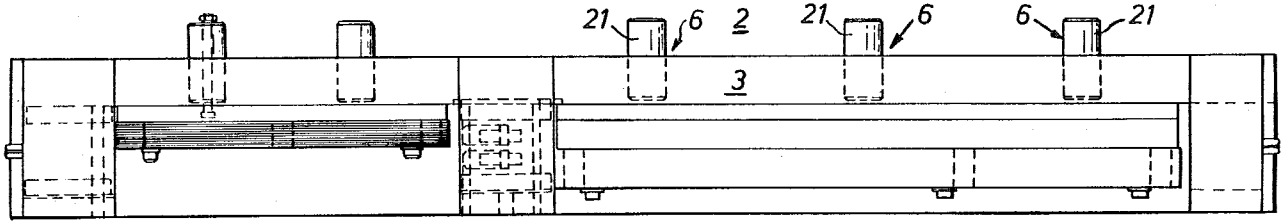
FIG. 2 shows a view of the apparatus of FIG. 1 on arrow 'A' of that Figure.
Figure 3:
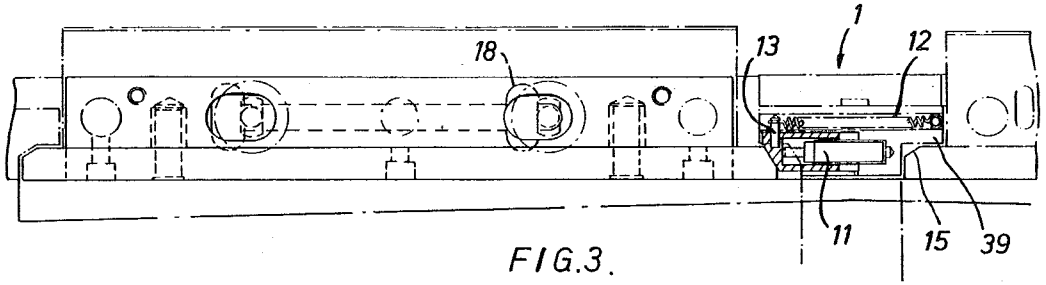
FIG. 3 shows an enlarged detail of part of FIG. 1.
Figure 4:
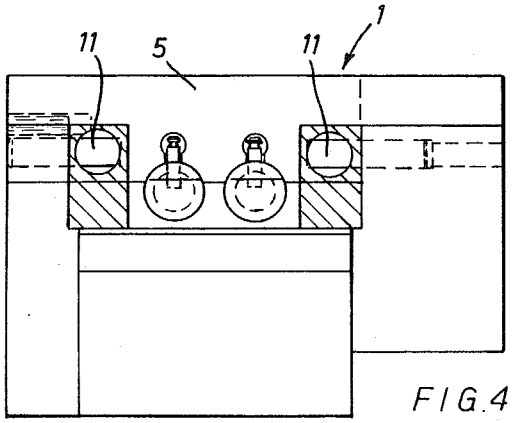
FIG. 4 shows a transverse sectional view through a centre block of FIGS. 1 to 3, to an enlarged scale.

Referring firstly to FIGS. 1–6 of the drawings, there is shown apparatus 1 for holding a tool of a machine 2 for pressure forming surface configurations on a rotary workpiece comprising an elongate support 3 (of L-shape) on which a tool 4 is mountable, first automatic 5 means for shifting the support 3 longitudinally for adjusting the position of the tool 4, and second automatic means 6 for securing the support 3 in a shifted position.

FIGS. 1 to 5 shows part of a machine 2 which has a base or bed 7 which has two lower (as considered in use) tools, incorporating the invention, it being understood that the machine includes two upper tools (not shown) which correspond with the tools 4 shown and which also incorporate the invention.

The first automatic means 5 comprises a block 8 which contains plungers having bearing surfaces 9 for bearing on an inclined surface 10 of the support 3. The two surfaces 9 and 10 when engaged provide both horizontal and vertical elements of force on support 3 to move the support 3 and to retain it in the shifted positions.

The block 8 includes hydraulic means in the form of two spaced parallel hydraulic cylinder and sliding plunger arrangements 11 and two resilient means in the form of tension springs 12 secured between posts 13 of the plungers and block 8, arranged to retain the plungers in contact with the hydraulic cylinder rams.

Figure 5:
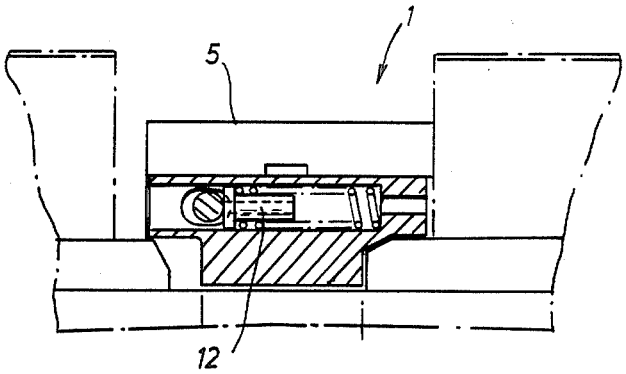
FIG. 5 shows a longitudinal sectional view through the centre and left hand end blocks.
Figure 6:
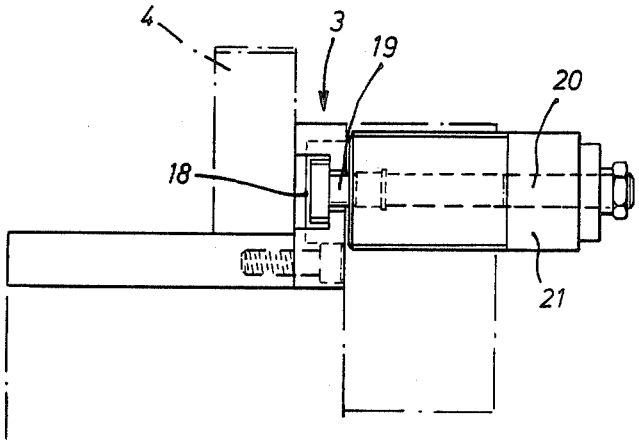
FIG. 6 shows a transverse sectional view through a second automatic means for securing a support of the tool.

There is a first automatic means 5 mounted within the blocks secured to base 7 at the right hand end of both the tool supports 3 (as considered in FIG. 1). Additionally pairs of sliding members acted upon by compression springs (as depicted in FIG. 5) are mounted into the centre and left hand blocks such that angled faces of these sliding members bear upon similarly angled surfaces at the left end of both tool supports 3 (as considered in FIG. 1). The angled surfaces of the sliding members and tool supports 3 are arranged to provide predominantly downward, (as considered in FIG. 1) forces when urged into contact with each other by the extension of hydraulic cylinders and sliding plungers 11.

The central block 1' (and the left hand one) are situated below a fixed hardened steel datum piece 16 the right hand face of which (in each case) forms a datum line for the position of the respective tools 4.

The second automatic means 6 of the tool support 3 comprises complementary locking and engaging means of each support 3 and a clamp 19 therefor, the clamp 19 being operative to clamp the support 3 in a direction transversely to the longitudinal axis of the support, the direction of clamping suitably being at 90° to the longitudinal axis in the embodiment shown. The complementary locking and engaging means comprises a series of T-or key-hole configured slots 18 in the rear (as considered in use) of the support 3 and a T-section clamp 19 resiliently mounted under pressure of a spring 20 normally to engage the support and clamp it and hydraulic means in the form of a hydraulic cylinder 21 operative to overcome the pressure of the spring 20 for disengaging the support 3 and clamps 6 when the support 3 moves longitudinally. The T-or key-hole slots 18 are arranged spaced along the length of the support with their longitudinal axes horizontal. The hydraulic means of the first and second automatic means 5 and 6 are operated automatically in synchronism for shifting the support 3 and securing it in a shifted position.

The machine also includes apparatus comprising a device 21 for adjusting the vertical position of the support 3 and may include motor means 22 for actuating the device 21 whereby the vertical position of the support 3 is adjusted. Each tool support 3 in the embodiment shown is mounted on its own device which is in the form of a wedge 23 shiftable bodily, longitudinally to adjust the vertical height of the respective support 3. The wedge 23 for the right hand tool support is movable bodily to the left (as viewed in FIG. 1) to raise the right hand support, the left hand wedge is movable bodily to the right (as viewed in FIG. 1) to raise the left hand support. The wedges 23 are mounted between the respective tool supports 3 and the base 7 of the machine 2 for reciprocable sliding motion to raise and lower the supports for adjusting the vertical position of the supports.

The motor actuating means 22 may comprise a nut 24 retained in the wedge 23 (FIG. 8) against movement longitudinally of the wedge 23, but which is free to float vertically with respect to the wedge. A screw-threaded rod or shaft 25 is journalled in the nut and, at the opposite end thereto, outside the wedge, the shaft carries a drive connector 26. A ball spline shaft 27 is mounted parallel to the threaded shaft 25, one end being journalled for rotation in the bed of the machine, the drive connector 26 being connected with a drive connector 28 of the ball spline shaft via a timing belt drive 29, the ball spline shaft 27 being driven by a stepping motor 30, gear box 31 and coupling 32 to provide a suitable transmission system.

Figure 7:
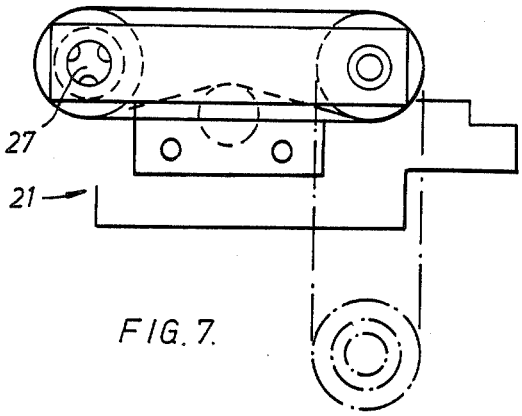
FIG. 7 shows schematically apparatus for adjusting a tool of a machine for pressure forming surface configurations on a rotary workpiece.

The ball spline shaft can be arranged horizontally alongside as shown in FIG. 7, or vertically below the threaded shaft as shown in FIG. 7 (chain dashed line) and FIG. 8.

Figure 9:
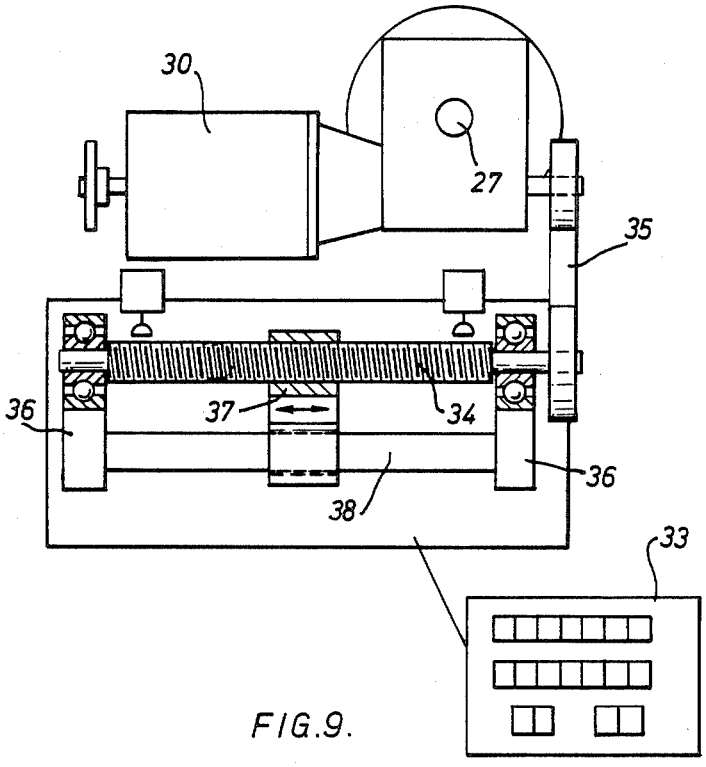
FIG. 9 shows schematically a further detail of the apparatus of FIGS. 7 and 8.

The apparatus 50 for adjusting the position of the wedge 23 and hence of the tool 4 can be connected to a remote control device 33 for providing control and read out of the wedge, as shown in Fig. 9. The extended gear box input shaft which via the gear box is connected to the ball spline shaft 27 and to a threaded calibration screw 34 via a timing belt 35, the screw 34 being mounted for rotation in fixed blocks 36 and carrying a slider 37 which traverses a linear read-out scale 38 which is connected with the device 33, which is a numerical counter to set the incremental adjustment of the wedges 23. The counter provides a read-out display for both top and bottom wedges, and decade counters to set and adjust any increment. Using this apparatus the tools can be automatically adjusted by push button control from the counter, and there are no wires on the machine bed or table. The counter can be numerically controlled for fully automatic operation.

In use of the apparatus described herein, and considering the right hand side only as the left hand side operates in an identical fashion, the tool 4 such as a rack for forming splines can be readily mounted on the machine 2 with the hydraulic fluid to the first 5 automatic operating means "off" and the hydraulic fluid to the second automatic operating means 6 "on", so that the block 8 is to the right (considering the right hand tool, FIG. 1) and the T-section clamps 19 being extended against the pressure of the springs 20. The heads of the T-section rods 19 are aligned with the enlarged part of the T-section or key-hole slots 18 of the support 3, and the inclined bearing surfaces 9 and 10, 14 and 15 are not engaged. The tool support 3 can thus be mounted directly into the machine by sliding at 90° to the length of the support, that is through the plane of the paper as viewed in FIG. 1, by passing the enlarged heads of the slots 18 over the heads of clamps 19. When on the clamps 19, the first automatic actuating 5 means is actuated to engage the bearing surfaces 9 and 10 and 14 and 15 by shifting the support bodily to the left until the left hand edge (as viewed) butts against the datum 16, by applying fluid pressure to the cylinders 11 of the block 8 to move the plungers 9 to the left to overcome the pressure of the springs 12. This bodily shifting of the tool support 3 moves the key-hole slots 18 over the T-clamps 19 so that the T-head of each clamp 19 is in the support 3 behind parts of the support flanking the narrow limb of the "T". The hydraulic pressure of fluid of the second actuating means 6 is released so that the T-clamps 19 are urged by the respective springs 20 to the rear of the machine (as considered in use) so that the T-section clamps and support firmly engage, to secure the supports and thus the tools in the correct position as considered transversely of the machine.

When surface configuration of a workpiece has been carried out, a reverse sequence of operation can be effected automatically to release the tool support for rapid change of the tool if necessary. Further, if the datum is adjusted for any reason, or the tool has to be adjusted longitudinally (it is usually a rack) because say of wear, the longitudinal position is readily automatically adjusted by means of the first and second automatic means. These means can be hydraulically linked so that when the first one is "off", the second one is "on" and vice versa. The automatic means for the bottom and top tools can be operated in synchronism using the apparatus.

Figure 8:
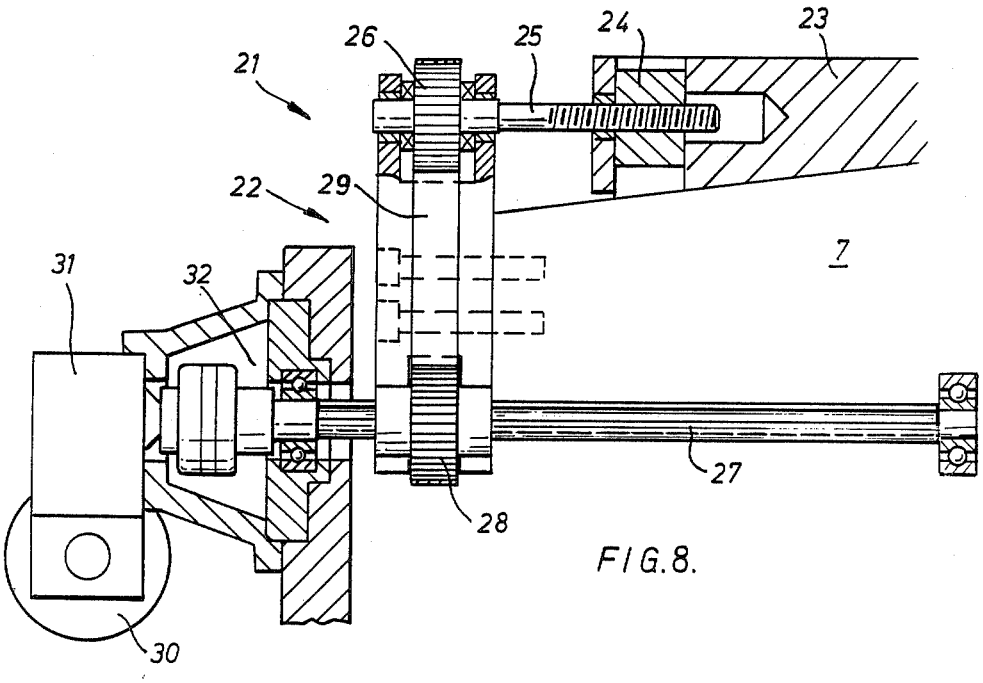
FIG. 8 shows an enlarged detail of the apparatus of FIG. 7.

If vertical adjustment of the tool is required, the apparatus 21 shown in FIGS. 7 to 9 is operated so that when the required incremental adjustment is set and the stepping motor 30 is operated to rotate the threaded shaft 25, rotation of that shaft 25 in the captive nut 24 results in movement of the wedge 23 longitudinally as desired to raise or lower the support 3. This operation can be numerically controlled by push button from the (remote) console 33.

It will be understood that any suitable means of wedge adjustment may be used other than the stepping motor arrangement shown. For example, a hydraulic system could be used. In every embodiment though, fully automatic adjustability is achieved, which may be remotely, and numerically controlled.

It will also be understood that the blocks 8 are identical, and each have an overhang or projection 39 from which the upper tool supports can be "hung", so that the blocks are completely universal in applications and are not orientation dependent in use.

We claim:

1. Apparatus for holding a tool of a machine for pressure forming surface configurations on a rotary workpiece comprising: an elongate support (3) on which a tool (4) is mountable, shifting means (5) for automatically shifting the support (3) longitudinally for adjusting the position of the tool (4), said shift means (5) including a first downwardly facing and inclined bearing surface (9) and said support (3) including an upwardly facing and angled second bearing surface (10) bearing upon said first bearing surface (9) and resilient means (12) normally urging said first bearing surface (9) away from said support (3) and hydraulic means (11) operative to urge said first bearing surface to engage said support (3); and locking means (6) for securing the support (3) in a shifted position, said locking means (6) including biasing means (20) for engaging the support (3) in a clamped condition and hydraulic means (11,21) for overcoming the force of the biasing means and releasing the support (3) for adjustment and replacement, said support (3) including at least one slot (18) therein extending along the length of said elongate support (3), said locking means (6) including a clamp (14) slideable in said slot (18) to unlock said support when said hydraulic means (21) overcomes the biasing force of said biasing means (20) for allowing longitudinal movement of said support (3) by said shifting means (5).

2. Apparatus according to claim 1, characterized by including a block (8) and the resilient means (12) comprising a spring connected at one end to the block (8) and at the other end to a stock in which the block (8) slides.

3. Apparatus according to claim 2, characterised in that the direction of clamping is substantially 90° to the longitudinal axis.

4. Apparatus according to claim 2 characterized by the complementary locking and engaging means comprising a T-or key-hole configured slot (18) of the support (3) and a T-section clamp (19) resiliently mounted by the biasing means (21) normally to engage the support and clamp it and by the hydraulic means (21) operative to overcome the biasing means (20) for disengaging the support (3) and clamp (17) when the support move longitudinally.

5. Apparatus according to claim 4, characterized by the shifting means (5) and locking means (6) being operated automatically in synchronism for shifting the support (3) and for securing same in a shifted position.

6. A machine for pressure forming surface configurations on a rotary workpiece, said machine comprising: a base (7); a pair of opposed substantially parallel tool supports (3) mounted on said base (7) for reciprocating movement and for supporting tools (4) which pressure form surface configurations on a rotary workpiece; tooth forming tools (4) removably mounted on said supports (3) and having opposed tooth forming surfaces; first automatic means (5) for automatically shifting said tool supports (3) longitudinally relative to said base (7) and positioning said tools (4) relative to each other, and second automatic means (6) for automatically releasing a tool support (3) for unloading, loading, shifting, and securing the loaded tool (4) and tool support (3) in a shifted position, characterized by said second automatic means (5,6) including biasing means (12,20) for engaging the support in a clamped condition and hydraulic means (11,21) for overcoming the force of the biasing means (12,20) and releasing the support for adjustment and replacement, said support (3) including at least one slot (18) therein extending along the length of said elongate support (3), said second automatic means (6) including a clamp (14) slideable in said slot (18) to unlock said support when said hydraulic means (21) overcomes the biasing force of said biasing means (20) for allowing longitudinal movement of said support (3) by said shift means (5).

* * * * *